US005673710A

United States Patent [19]

Schaefer et al.

[11] Patent Number: 5,673,710

[45] Date of Patent: Oct. 7, 1997

[54] APPLIANCE FOR TREATING HAIR

[75] Inventors: Norbert Schaefer, Frankfurt; Peter Janouch, Linsengericht; Silvia Kamalla, Schwalbach; Michael Stolper, Eschborn, all of Germany

[73] Assignee: Braun Aktiengesellschaft, Frankfurter, Germany

[21] Appl. No.: 391,498

[22] Filed: Feb. 21, 1995

[30] Foreign Application Priority Data

Feb. 23, 1994 [DE] Germany ..... 44 05 763.6

[51] Int. Cl.[6] ..... A45D 24/10; A45D 1/04

[52] U.S. Cl. ..... 132/118; 132/137; 132/161; 132/229

[58] Field of Search ..... 219/222, 225; 132/118, 227, 229, 230, 231, 232, 233, 271, 161, 137, 141

[56] References Cited

U.S. PATENT DOCUMENTS

| | | | |
|---|---|---|---|
| 1,221,447 | 4/1917 | Hebderson | 132/118 |
| 1,382,342 | 8/1921 | Caneavri | 132/118 |
| 1,473,312 | 11/1923 | Passard | 132/232 |
| 2,098,593 | 11/1937 | Quinio | 132/118 |
| 2,545,885 | 3/1951 | Jackson | 132/118 |
| 2,762,382 | 9/1956 | Morgan, Sr. | 219/222 |
| 3,660,634 | 5/1972 | Scott | 132/118 |
| 3,922,521 | 11/1975 | Viegut et al. | 132/229 |
| 3,970,093 | 7/1976 | Lardenois . | |
| 4,126,143 | 11/1978 | Schroeder . | |
| 4,163,143 | 7/1979 | Frederico et al. | 132/118 |
| 4,217,915 | 8/1980 | Gress et al. . | |
| 4,623,779 | 11/1986 | Raab | 219/222 |
| 4,656,684 | 4/1987 | Jewett | 132/212 |
| 4,963,027 | 10/1990 | Tsuji | 34/90 |
| 4,984,590 | 1/1991 | Bachtell | 132/161 |
| 5,212,366 | 5/1993 | McDougall | 219/222 |
| 5,400,809 | 3/1995 | Adams | 132/118 |

FOREIGN PATENT DOCUMENTS

| | | |
|---|---|---|
| 391 600 B | 10/1990 | Australia . |
| 2011581 | 9/1990 | Canada . |
| 1259521 | 1/1968 | Germany . |
| 2526637 A1 | 12/1976 | Germany . |

*Primary Examiner*—Todd E. Manahan
*Attorney, Agent, or Firm*—Edward S. Podszus

[57] ABSTRACT

The invention is directed to an appliance for treating hair (1), which is comprised of a handle section (2) and a heatable hair treatment section (3). The section (3) possesses an approximately tubular bristle mounting member (4) which is assembled from two half shells (7, 8). Projecting outwardly from the half shell (7) are bristles (5), and the half shell (8) is equipped with rib members (6). The radius (R1) of the cross section of the bristled half shell (7) is smaller than the radius (R2) of the cross section of the ribbed half shell (8). These different radii (R1, R2) enable a user both to form waves with long or medium long hair and to treat short hair in the area close to the scalp. The larger radius may be used for large-volume waves in particular where long hair is involved, while the smaller radius is suitable in particular for treating short hair as well as hair in the area close to the scalp.

138 Claims, 2 Drawing Sheets

APPLIANCE FOR TREATING HAIR

BACKGROUND OF THE INVENTION

This invention relates to an appliance for treating hair, with a handle section and a heatable hair treatment section including an approximately tubular bristle mounting means for receiving bristles.

DISCUSSION OF THE PRIOR ART

A hair treating appliance of this type is known, for example, from U.S. Pat. No. 4,126,143. This specification discloses a heatable comb in which a tooth mounting means is secured to a handle. Accommodated in the interior of the tooth mounting means is a heat generating element, and a plurality of tooth elements are secured to the outside of the tooth mounting means. The tooth mounting means is of a tubular cross-section, and the tooth elements are of an eyelet-shaped configuration with an outwardly projecting tip.

SUMMARY OF THE INVENTION

The disadvantage of such known appliances for treating hair is that they produce good styling results either with long hair only or with short hair only. For short hair, tooth mounting means having small cross sections are used, while tooth mounting means having small or large cross sections are utilized for long hair. The use of hair styling appliances having tooth mounting means with only small cross sections entails the disadvantage that large-volume waves or curls or the like cannot be formed therewith.

It is an object of the present invention to provide an appliance for treating hair which enables both short and long hair to be treated equally well with variable styling results, producing in particular small and large waves or curls.

According to the present invention, this object is accomplished in that the bristle mounting member has a cross section with two different radii.

By means of the different radii it is possible to form waves with long or medium long hair as well as to treat short hair in the area close to the scalp. The larger radius may be used for large-volume waves in particular where long hair is involved, while the smaller radius is suitable in particular for treating short hair as well as hair in the area close to the scalp. By using an appropriate turning motion about the longitudinal axis of the hair care appliance, the user is thus in a position to adapt the appliance of this invention optimally to the individual hair sections to be treated, thereby improving in particular the hair styling operation significantly.

In an advantageous embodiment of the present invention, the bristles project in the circumferential direction outwardly from the bristle mounting member only in an area of 180 degrees, approximately, and the radius of the cross section in this area of the bristle mounting member is smaller than in the remaining area. The small radius of the bristled area is particularly suited to treat short hair. It thus enables, for example, also the hair in the root area to be formed such as to stand straight out from the scalp. Further, the small radius enables small-volume waves and curls similar to naturally curly hair to be formed, and this with both long and medium long hair.

A further advantageous embodiment of the present invention consists in that the bristle mounting member is provided with outwardly projecting rib members of in particular different heights in the area of the cross section having the larger radius. The large radius is especially suitable for producing optimum results when curls and waves are formed particularly in long hair. On account of the large radius and by means of the rib members, the bristle mounting member is in a position to catch and guide the hair readily for styling. The large radius requires the operator to use only small turning motions. Further it is possible to pull the hair over the ribbed area with the large radius. In this manner, it is possible to straighten the hair.

In an advantageous further feature of the present invention, the bristle mounting member includes two half shells whose cross section is provided with a respective one of the two different radii. This affords greater ease of manufacture of the bristle mounting member. This feature eliminates the need to manufacture a component with two different radii, rather, the bristle mounting member can be simply assembled together from two separately fabricated half shells. Each half shell being provided with one of the different radii, the bristle mounting member, in assembled condition, affords the advantages described in the foregoing.

In a convenient embodiment of the present invention, one of the half shells is made of metal and the other half shell is made of a plastics material, with the bristles projecting from the half shell made of metal, whilst the rib members project from the half shell made of plastics. The half shell made of metal is especially suitable for transferring heat to the bristles. The bristles are thus heatable rapidly and effectively, enabling them to be put to optimum use for the treatment of hair, in particular for the styling of hair. The half shell made of plastics serves especially the function of preheating the hair and preparing it for a styling operation. The rib members operate to maintain a sufficient distance of the hot surface areas from the user's skin. Further, the rib members help the user in directing the hair so as to obtain the desired shape. Moreover, the rib members serve to additionally heat the strands of hair between which they are guided, which is accomplished by their contact with a larger heated area. In particular, separated strands can be held together by the rib members and thus be treated separately.

It has proven to be particularly suitable in practice to provide the reduced smaller radius with a value of between 14 mm and 20 mm, approximately, in particular 17 mm, approximately, and the larger radius with a value of between 35 mm and 45 mm, approximately, in particular 40 mm, approximately. By assigning these values to the two different radii, it is possible to treat and especially style long, medium long and also short hair to particular advantage.

In an advantageous further feature of the present invention, the radius in the transition area between the two areas of different radii is smaller than the two radii. The transition area is thus the area having the smallest radius. This smallest radius is especially suitable for styling the hair in the area close to the scalp, because the hair can still be caught in this area by the smallest radius for styling. For example, by means of this smallest radius it is possible to form hair so as to make it stand out from the scalp particularly well.

It has proven to be particularly suitable in practice to provide the radius in the transition area with a value of between 2 mm and 6 mm, approximately, in particular 4 mm, approximately.

In another advantageous further feature of the present invention, the bristles are disposed in offset relation to each other in the circumferential direction. In this manner, the adjacent bristles form a channel in the circumferential direction retaining the hair optimally in this circumferential direction of the bristle mounting means. The channel provides a lateral support for the hair, preventing it from escaping laterally. Especially when pulled over the bristle mounting member, the hair engages the bristles with a slight pressure. As a result, the generated heat can be transferred to the hair particularly well, permitting a speedy and optimal hair styling operation.

In a convenient embodiment of the present invention, the bristles form in the circumferential direction a line of arc or a serpentine or a diagonal line. Accordingly, corresponding channels are formed between the bristles which have proven to be particularly advantageous in practice. In particular with the arc-shaped arrangement of the channels it has been possible to accomplish excellent results in practice.

Further features, advantages and application possibilities of the present invention will become apparent from the subsequent description of an embodiment illustrated in more detail in the accompanying drawings. It will be understood that any single feature and any combination of single features described and/or represented by illustration form the subject-matter of the present invention, irrespective of their summarization in the claims and their back-references.

DETAILED DESCRIPTION OF EMBODIMENTS

Figure 1:
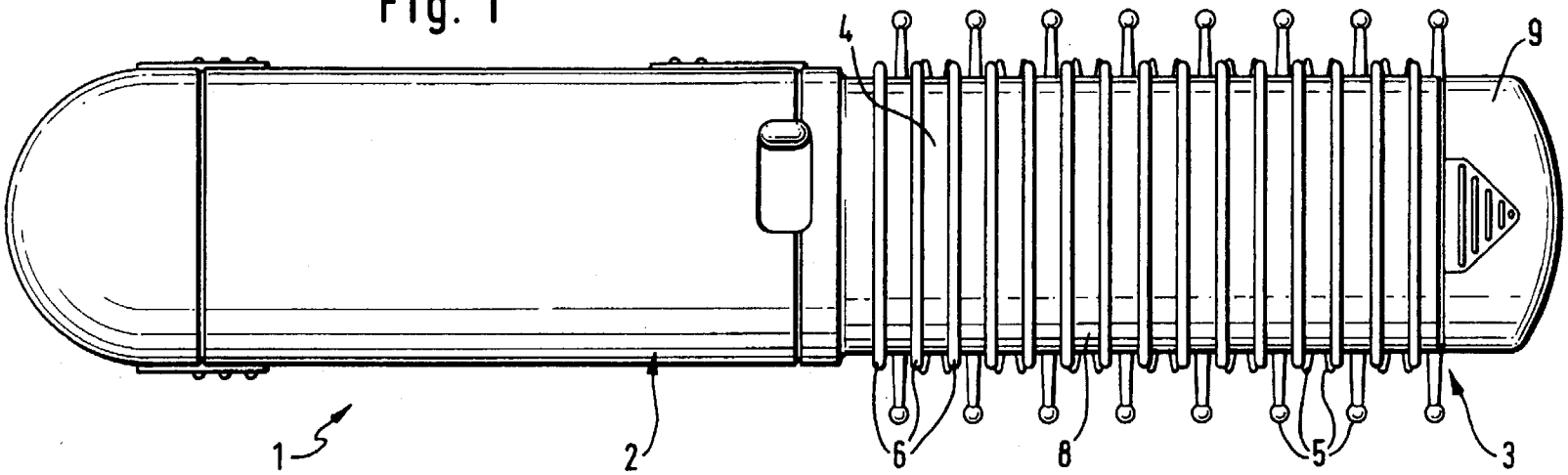
FIG. 1 is a schematic representation of an appliance for treating hair, as seen when looking from the direction A of FIG. 3.
Figure 2:
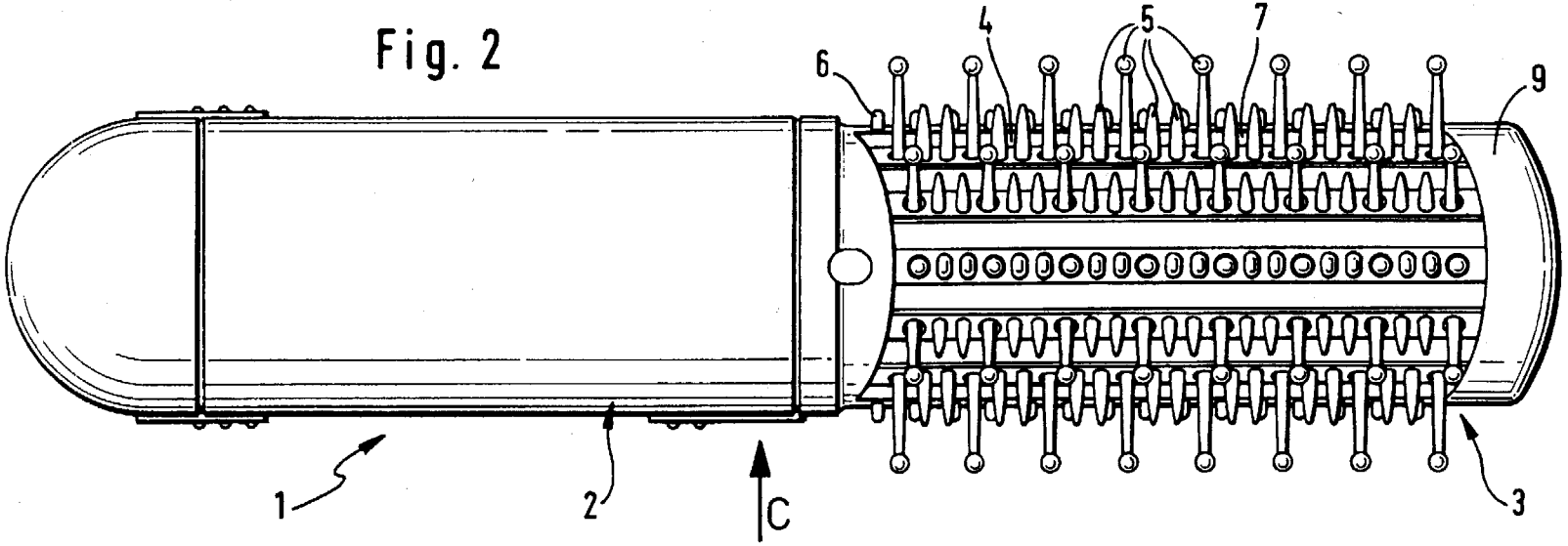
FIG. 2 is a schematic representation of the appliance for treating hair of FIG. 1, as seen when looking from the direction B of FIG. 3.
Figure 3:
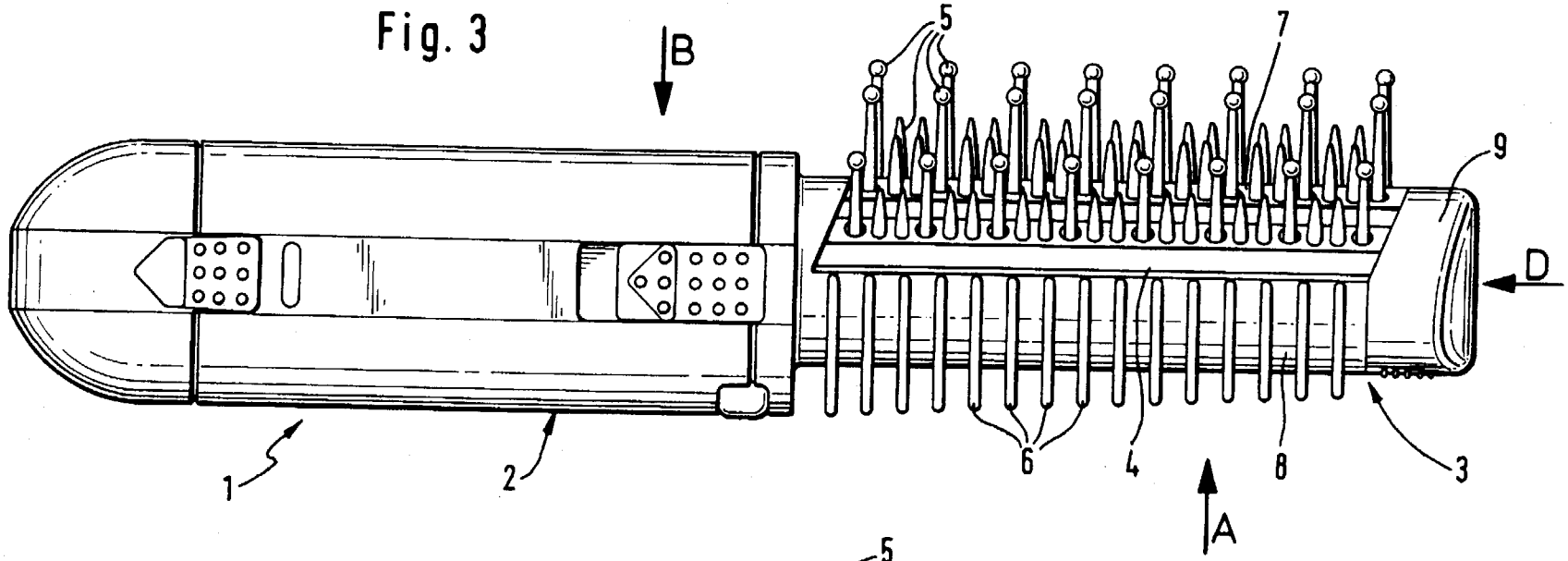
FIG. 3 is a schematic representation of the appliance for treating hair of FIG. 1, showing a side view from the direction C of FIG. 2.
Figure 4:
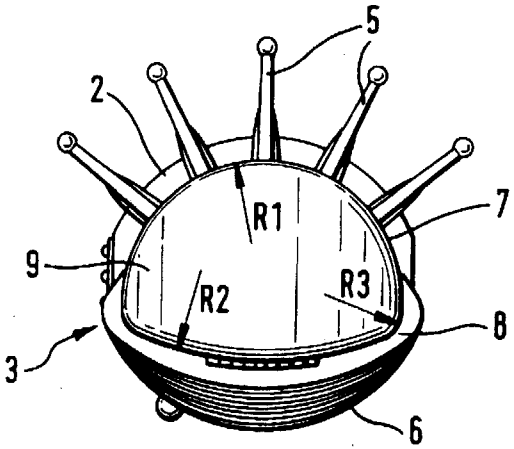
FIG. 4 is a schematic representation of the appliance for treating hair of FIG. 1, as seen when looking from the direction D of FIG. 3.

Referring now to FIGS. 1 to 4 of the drawings, there is shown an appliance for treating hair 1 which is composed of a handle section 2 and a hair treatment section 3. The appliance for treating hair 1 is of a rod-shaped or tubular configuration possessing a longitudinal axis. Extending in the direction of this longitudinal axis are the handle section 2 and the hair treatment section 3 which are of approximately equal lengths. The diameter of the handle section 2 is essentially constant. In the area of transition to the handle section 2, the diameter of the hair treatment section 3 is slightly greater than that of the handle section 2, tapering at least in part towards the free end of the hair treatment section 3.

Received in the interior of the hair treatment section 3 is a heating cartridge or the like by means of which the hair treatment section 3 can be heated. For this purpose, the heating cartridge may include a heating spiral or the like to which electrical energy for the generation of heat is supplied, or alternatively, the heating cartridge includes a gas tank as well as means for the combustion of the gas, in order to generate heat in this manner. The handle section 2 includes one or several switches and the like, enabling a user to control, in particular to activate and deactivate, the generation of heat.

The hair treatment section 3 includes a bristle mounting member 4 from which a plurality of bristles 5 and rib members 6 project outwardly. Similar to the hair treatment section 3, the bristle mounting member 4 is of a barrel-shaped and elongate configuration. The bristles 5 and the rib members 6 project from the bristle mounting member 4 approximately radially. The envelope surface formed by the free ends of the bristles 5 and the rib members 6 is equally of an approximately barrel-shaped configuration, with the rib members 6 tapering towards the free end of the hair treatment section 3.

The bristle mounting member 4 is composed of two half shells 7, 8 which both extend approximately along the full length of the hair treatment section 3, each half shell accounting for about 180 degrees in the circumferential direction, that is, for about half of the bristle mounting member 4. Provided at the free end of the hair treatment section 3 is an end portion 9 in which the two half shells 7, 8 terminate. The bristles 5 project outwardly from the half shell 7, whilst the rib members 6 project outwardly from the half shell 8. Thus, the bristles 5 and the rib members 6 project in the circumferential direction from the bristle mounting member 4 only in a respective area of 180 degrees, approximately.

In cross section, the two half shells 7, 8 are provided with different radii R1, R2. The radius R1 of the bristled half shell 7 is smaller than the radius R2 of the ribbed half shell 8. In the present embodiment, the radius R1 has a value of 17 mm, and the radius R2 a value of 40 mm; it will be understood that in embodiments configured differently values departing from these may be provided.

In the two transition areas in which the two half shells 7, 8 merge into each other circumferentially, a radius R3 is provided which is smaller than any one of the two radii R1, R2 previously mentioned. In the present embodiment, the radius R3 has a value of 3.5 mm, approximately; it will be apparent that other values may be provided in other embodiments.

The bristles 5 projecting outwardly from the half shell 7 are not arranged on a circumferential line in the circumferential direction, but are disposed in offset relation to each other. In the present embodiment, the relative arrangement of the bristles 5 is such that they form a line of arc in the circumferential direction. In other embodiments, it is also possible for the bristles 5 to form a serpentine or a diagonal line in the circumferential direction.

In the present embodiment, five bristles 5 are arranged in a row in the circumferential direction and are approximately uniformly distributed on the half shell 7 over an area slightly smaller than 180 degrees. In the longitudinal direction of the half shell 7, twenty-two such rows are provided spaced uniformly apart, with one row of long bristles 5 alternating with two rows of shorter bristles 5. The shorter bristles 5 are made of metal while the longer bristles 5 are made of plastics. The first and the last row in the longitudinal direction are provided with the long bristles 5 made of plastics. Advantageously, the bristles of the two rows at the laterally outer ends are completely made of plastics to prevent direct user contact with the metal bristles which are heated to relatively high temperatures. These outer rows of bristles protect the inner bristle rows including those equipped with metal bristles.

The bristles 5 are retained in the half shell 7 by means of bristle strips extending in the longitudinal direction, and are passed through appropriate bores in the half shell 7. The bristle strips carrying the short bristles 5 are therefore made of metal, whilst the bristle strips carrying the long bristles 5 are made of plastics. The half shell 7 itself is made of metal.

The rib members 6 projecting outwardly from the half shell 8 are arranged in the circumferential direction, that is, transversely to the longitudinal direction of the bristle mounting means 4. In the longitudinal direction, the rib members 6 are spaced uniformly apart by a relative distance of 3 mm, approximately. When viewed in the direction of the longitudinal axis of the bristle mounting means 4, the rib members 6 are of an approximately crescent-shaped configuration extending in the circumferential direction over an area of 180 degrees, approximately. The height of the rib members 6 is at its maximum at the first rib member 6 at the end close to the handle section 2, diminishing approximately continually down to the last rib member 6 at the free end of the bristle mounting member 4. In this arrangement, the lateral rib end is configured such as to eliminate the possibility of user contact with the metal insert, thus protecting the user from any painful contact with the metal insert.

The half shell 8 and the rib members 6 projecting outwardly therefrom are made of a plastics material, in particular, polyamide, and they are fabricated as a single-piece injection molding.

We claim:

1. An appliance for treating hair of a user comprising a handle section, a heating element, and a heatable hair treatment section in operative engagement with the handle section and in heat transfer relationship to the heating element, the hair treatment section further comprising an elongated bristle mounting member having a longitudinal axis and comprising first and second hair treatment surfaces curving about the longitudinal axis, and the hair treatment section further comprising a plurality of bristles carried by the bristle mounting member on at least one of said hair treatment surfaces, said plurality of bristles extending in a circumferential direction about the longitudinal axis and being carried on said at least one hair treatment surface arranged in a plurality of generally longitudinally extending rows, the plurality of bristles forming a plurality of channels therebetween for engaging and directing the hair transversely about the longitudinal axis towards said at least one hair treatment surface and between said rows, wherein in cross section of the bristle mounting member transverse to the longitudinal axis the first hair treatment surface is shaped at least partially coincident with a first radius and the second hair treatment surface is shaped at least partially coincident with a second radius different from the first radius, whereby either of the first or second hair treatment surfaces can treat the hair of the user.

2. An appliance for treating hair as claimed in claim 1, wherein the plurality of bristles is provided on one of the first and second hair treatment surfaces extending in the circumferential direction greater than 90 degrees about the longitudinal axis.

3. An appliance for treating hair as claimed in claim 2, wherein the bristle mounting member further comprises a plurality of rib members provided on the other of the first and second hair treatment surfaces, wherein the rib members extend in a circumferential direction transverse to the longitudinal axis.

4. An appliance for treating hair as claimed in claim 3, wherein the plurality of bristles is provided on the first hair treatment surface and the plurality of rib members is provided on the second hair treatment surface and wherein the first radius is smaller than the second radius.

5. An appliance for treating hair as claimed in claim 4, wherein the hair treatment section further comprises a proximal end being proximate the handle section and a free end located in an outward direction along the longitudinal axis from the handle section, and wherein an outer edge of the rib member proximate the proximal end is further from the longitudinal axis than an outer edge of the rib member proximate the free end is from the longitudinal axis.

6. An appliance for treating hair as claimed in claim 3, wherein the plurality of ribs extends in the circumferential direction about the longitudinal axis up to about 180 degrees.

7. An appliance for treating hair as claimed in claim 3, wherein the plurality of bristles is provided on the first hair treatment surface and the plurality of rib members is provided on the second hair treatment surface and wherein the first hair treatment surface further comprises metal and the plurality of rib members further comprises plastics.

8. An appliance for treating hair as claimed in claim 2, wherein the plurality of bristles is provided on the first hair treatment surface and wherein the first radius is smaller than the second radius.

9. An appliance for treating hair as claimed in claim 2, wherein the plurality of bristles extends in the circumferential direction about the longitudinal axis up to about 180 degrees.

10. An appliance for treating hair as claimed in claim 1 wherein the bristle mounting member comprises at least a first and a second shell, wherein the first shell further comprises at least partially the first hair treatment surface and the second shell further comprises at least partially the second hair treatment surface.

11. An appliance for treating hair as claimed in claim 10, wherein the shells are selected from a group of materials consisting of metal and plastics.

12. An appliance for treating hair as claimed in claim 10, wherein the first shell further is formed at least partially coincident with the first radius and the second shell further is formed at least partially coincident with the second radius.

13. An appliance for treating hair as claimed in claim 1 wherein the first radius is between about 14 mm and about 20 mm.

14. An appliance for treating hair as claimed in claim 13, wherein the second radius is between about 35 mm and about 45 mm.

15. An appliance for treating hair as claimed in claim 14, wherein the first radius is about 17 mm and the second radius is about 40 mm.

16. An appliance for treating hair as claimed in claim 1 further comprising a transition area having a transition radius between the first and second hair treatment surfaces, wherein the transition radius is smaller than the first and second radii.

17. An appliance for treating hair as claimed in claim 16, wherein the transition radius is between about 2 mm and about 6 mm.

18. An appliance for treating hair as claimed in claim 17, wherein the transition radius is about 3.5 mm.

19. An appliance for treating hair as claimed in claim 1 wherein the bristles are disposed in offset relation to each other in the circumferential direction.

20. An appliance for treating hair as claimed in claim 19, wherein the bristles are arranged in the circumferential direction in a shape selected from a group consisting of a line of arc, a serpentine and a diagonal line.

21. An appliance for treating hair as claimed in claim 1, wherein the first and second hair treatment surfaces have major portions coincident with the respective first and second radii.

22. An appliance for treating hair as claimed in claim 1, wherein the plurality of bristles is provided on the first hair treatment surface and wherein the first radius is smaller than the second radius.

23. An appliance for treating hair as claimed in claim 22, wherein the bristle mounting member further comprises a plurality of rib members provided on the second hair treatment surface, wherein the rib members extend in a circumferential direction transverse to the longitudinal axis.

24. An appliance for treating hair as claimed in claim 23, wherein the hair treatment section further comprises a proximal end being proximate the handle section and a free end located in an outward direction along the longitudinal axis from the handle section, and wherein an outer edge of the rib member proximate the proximal end are further from the longitudinal axis than an outer edge of the rib member proximate the free end is from the longitudinal axis.

25. An appliance for treating hair as claimed in claim 24 wherein a height of the rib members tapers from the proximal end to the free end.

26. An appliance for treating hair as claimed in claim 1, wherein a ratio between the second radius and the first radius is at least about 1.75:1.

27. An appliance for treating hair as claimed in claim 1, wherein the heating element is selected from a group of heating elements consisting of an electric heater and a gas combustion means.

28. An appliance for treating hair as claimed in claim 1, wherein the first and second radii do not share a center.

29. An appliance for styling hair of a user comprising a handle section, a heating element, and a heatable hair treatment section in operative engagement with the handle section and in heat transfer relationship to the heating element, the hair treatment section further comprising an elongated bristle mounting member having a longitudinal axis and comprising a first and a second hair treatment surface, and the hair treatment section further comprising a plurality of bristles carried by the bristle mounting member on at least one of said hair treatment surfaces, said plurality of bristles extending in a circumferential direction about the longitudinal axis and being carried on said at least one hair treatment surface arranged in a plurality of generally longitudinally extending rows, the plurality of bristles forming a plurality of channels therebetween for engaging and directing the hair transversely about the longitudinal axis towards said at least one hair treatment surface and between said rows, wherein the first and second hair treatment surfaces further comprise at least partially respective first and second curvilinear surfaces and are concave facing the longitudinal axis, and wherein in cross section of the bristle mounting member transverse to the longitudinal axis, an incremental arc of travel θ circumferentially along the first hair treatment surface defines two points on the first surface separated by a first chordal distance whereas the incremental arc of travel θ circumferentially along the second hair treatment surface defines two points on the second surface separated by a second chordal distance greater than the first chordal distance, whereby either of the first or second hair treatment surfaces can style the hair of the user.

30. An appliance for styling hair as claimed in claim 29, wherein the plurality of bristles is provided on one of the first and second hair treatment surfaces extending in the circumferential direction greater than 90 degrees about the longitudinal axis.

31. An appliance for styling hair as claimed in claim 30, wherein the bristle mounting member further comprises a plurality of rib members provided on the other of the first and second hair treatment surfaces, wherein the rib members extend in a circumferential direction transverse to the longitudinal axis.

32. An appliance for styling hair as claimed in claim 31, wherein the plurality of bristles is provided on the first hair treatment surface and the plurality of rib members is provided on the second hair treatment surface.

33. An appliance for styling hair as claimed in claim 32, wherein the hair treatment section further comprises a proximal end being proximate the handle section and a free end located in an outward direction along the longitudinal axis from the handle section, and wherein an outer edge of the rib member proximate the proximal end are further from the longitudinal axis than an outer edge of the rib member proximate the free end is from the longitudinal axis.

34. An appliance for styling hair as claimed in claim 31, wherein the hair treatment section further comprises a proximal end being proximate the handle section and a free end located in an outward direction along the longitudinal axis from the handle section, and wherein an outer edge of the rib member proximate the proximal end is further from the longitudinal axis than an outer edge of the rib member proximate the free end is from the longitudinal axis.

35. An appliance for styling hair as claimed in claim 34, wherein a height of the rib members tapers from the proximal end to the free end.

36. An appliance for styling hair as claimed in claim 31, wherein the plurality of ribs extends in the circumferential direction about the longitudinal axis up to about 180 degrees.

37. An appliance for styling hair as claimed in claim 30, wherein the plurality of bristles is provided on the first hair treatment surface.

38. An appliance for styling hair as claimed in claim 30, wherein the plurality of bristles extends in the circumferential direction about the longitudinal axis up to about 180 degrees.

39. An appliance for styling hair as claimed in claim 31, wherein the plurality of bristles is provided on the first hair treatment surface and the plurality of rib members is provided on the second hair treatment surface and wherein the first hair treatment surface further comprises metal and the plurality of rib members further comprises plastics.

40. An appliance for styling hair as claimed in claim 29, wherein the plurality of bristles is provided on the first hair treatment surface.

41. An appliance for styling hair as claimed in claim 29, wherein the first and second hair treatment surfaces further comprise material selected from a group of materials consisting of metal and plastics.

42. An appliance for styling hair as claimed in claim 29, wherein the first and second curvilinear surfaces are each formed from a generatrix of points generated by portions of a right circular cone intersected by a plane.

43. An appliance for styling hair as claimed in claim 42, wherein at least one of the first and second curvilinear surfaces is formed from a radius.

44. An appliance for styling hair as claimed in claim 29 wherein the bristles are disposed in offset relation to each other in the circumferential direction.

45. An appliance for styling hair as claimed in claim 29 wherein the bristles further comprise in the longitudinal direction at least one short bristle alternating with at least one long bristle.

46. An appliance for styling hair as claimed in claim 29 wherein the bristle mounting member comprises at least a first and a second shell, wherein the first shell further comprises at least partially the first hair treatment surface and the second shell further comprises at least partially the second hair treatment surface.

47. An appliance for styling hair as claimed in claim 29, wherein the shells are selected from a group of materials consisting of metal and plastics.

48. An appliance for styling hair of a user comprising a handle section, a heating element, and a heatable hair treatment section in operative engagement with the handle section and in heat transfer relationship to the heating element, the hair treatment section further comprising an elongated bristle mounting member having a longitudinal axis and comprising a first and a second hair treatment surface, and the hair treatment section further comprising a plurality of bristles carried by the bristle mounting member on at least one of said hair treatment surfaces, said plurality of bristles extending in a circumferential direction about the longitudinal axis and being carried on said at least one hair treatment surface arranged in a plurality of generally longitudinally extending rows, the plurality of bristles forming a plurality of channels therebetween for engaging and directing the hair transversely about the longitudinal axis towards said at least one hair treatment surface and between said rows, wherein in cross section of the bristle mounting member transverse to the longitudinal axis each of the first and second hair treatment surfaces is concave facing the longitudinal axis and at at least one region on the first hair treatment surface a first point moving towards the longitudinal axis along the first hair treatment surface translates an incremental distance "y" as projected onto to a first vertical axis constructed normal to the longitudinal axis from a location on the first hair treatment surface furthest from the longitudinal axis while simultaneously translating an incremental distance "x" as projected onto a first horizontal axis constructed normal to each of the first vertical axis and the longitudinal axis, whereas a second point moving towards the longitudinal axis along the second hair treatment surface translates towards the longitudinal axis by an incremental distance less than "y" as projected onto a second vertical axis constructed normal to the longitudinal axis from a location on the second hair treatment surface furthest from the longitudinal axis when the second point translates the incremental distance "x" as projected onto a second horizontal axis constructed normal to each of the second vertical axis and the longitudinal axis, whereby either of the first or second hair treatment surfaces can style the hair of the user.

49. An appliance for styling hair as claimed in claim 48, wherein the plurality of bristles is provided on one of the first and second hair treatment surfaces extending in the circumferential direction greater than 90 degrees about the longitudinal axis.

50. An appliance for styling hair as claimed in claim 49, wherein the plurality of bristles is provided on the first hair treatment surface.

51. An appliance for styling hair as claimed in claim 49, wherein the plurality of bristles extends in the circumferential direction about the longitudinal axis up to about 180 degrees.

52. An appliance for styling hair as claimed in claim 48, wherein the bristle mounting member further comprises a plurality of rib members provided on the other of the first and second hair treatment surfaces, wherein the rib members extend in a circumferential direction transverse to the longitudinal axis.

53. An appliance for styling hair as claimed in claim 52, wherein the plurality of bristles is provided on the first hair treatment surface and the plurality of rib members is provided on the second hair treatment surface.

54. An appliance for styling hair as claimed in claim 53, wherein the hair treatment section further comprises a proximal end being proximate the handle section and a free end located in an outward direction along the longitudinal axis from the handle section, and wherein an outer edge of the rib member proximate the proximal end are further from the longitudinal axis than an outer edge of the rib member proximate the free end is from the longitudinal axis.

55. An appliance for styling hair as claimed in claim 52, wherein the plurality of ribs extends in the circumferential direction about the longitudinal axis up to about 180 degrees.

56. An appliance for styling hair as claimed in claim 52, wherein the hair treatment section further comprises a proximal end being proximate the handle section and a free end located in an outward direction along the longitudinal axis from the handle section, and wherein an outer edge of the rib member proximate the proximal end is further from the longitudinal axis than an outer edge of the rib member proximate the free end is from the longitudinal axis.

57. An appliance for styling hair as claimed in claim 56, wherein a height of the rib members tapers from the proximal end to the free end.

58. An appliance for styling hair as claimed in claim 52, wherein the plurality of bristles is provided on the first hair treatment surface and the plurality of rib members is provided on the second hair treatment surface and wherein the first hair treatment surface further comprises metal and the plurality of rib members further comprises plastics.

59. An appliance for styling hair as claimed in claim 48, wherein the plurality of bristles is provided on the first hair treatment surface.

60. An appliance for styling hair as claimed in claim 48, wherein the first and second hair treatment surfaces are each formed from a generatrix of points generated by portions of a right circular cone intersected by a plane.

61. An appliance for styling hair as claimed in claim 60, wherein at least one of the first and second hair treatment surfaces is formed from a radius.

62. An appliance for styling hair as claimed in claim 48 wherein the bristles are disposed in offset relation to each other in the circumferential direction.

63. An appliance for styling hair as claimed in claim 48 wherein the bristles further comprise in the longitudinal direction at least one short bristle alternating with at least one long bristle.

64. An appliance for styling hair as claimed in claim 48 wherein the bristle mounting member comprises at least a first and a second shell, wherein the first shell further comprises at least partially the first hair treatment surface and the second shell further comprises at least partially the second hair treatment surface.

65. An appliance for styling hair as claimed in claim 64, wherein the shells are selected from a group of materials consisting of metal and plastics.

66. An appliance for styling hair as claimed in claim 48, wherein the first and second hair treatment surfaces further comprise material selected from a group of materials consisting of metal and plastics.

67. An appliance for styling hair of a user comprising a handle section, a heating element, and a heatable hair treatment section in operative engagement with the handle section and in heat transfer relationship to the heating element, the hair treatment section further comprising an elongated bristle mounting member having a longitudinal axis and comprising a first and a second hair treatment surface, and the hair treatment section further comprising a plurality of bristles carried by the bristle mounting member on one of said hair treatment surfaces and a plurality of rib members provided on the other of said hair treatment surfaces, wherein the rib members extend in a circumferential direction transverse to the longitudinal axis and said plurality of bristles extends in a circumferential direction about the longitudinal axis and is carried on said one hair treatment surface arranged in a plurality of generally longitudinally extending rows, the plurality of bristles forming a plurality of channels therebetween for engaging and directing the hair transversely about the longitudinal axis towards said one hair treatment surface and between said rows, wherein the first and second hair treatment surfaces further comprise at least partially a respective first and second curvilinear surface, and wherein in cross section of the bristle mounting member transverse to the longitudinal axis, an incremental arc of travel θ circumferentially along the first hair treatment surface defines two points on the first surface separated by a first chordal distance whereas the incremental arc of travel θ circumferentially along the second hair treatment surface defines two points on the second surface separated by a second chordal distance greater than the first chordal distance, whereby either of the first or second hair treatment surfaces can style the hair of the user.

68. An appliance for styling hair as claimed in claim 67, wherein the plurality of bristles extends in the circumferential direction greater than 90 degrees about the longitudinal axis.

69. An appliance for styling hair as claimed in claim 68, wherein the plurality of bristles is provided on the first hair treatment surface.

70. An appliance for styling hair as claimed in claim 69, wherein the hair treatment section further comprises a proximal end being proximate the handle section and a free end located in an outward direction along the longitudinal axis from the handle section, and wherein an outer edge of the rib member proximate the proximal end are further from the longitudinal axis than an outer edge of the rib member proximate the free end is from the longitudinal axis.

71. An appliance for styling hair as claimed in claim 68, wherein the plurality of bristles extends in the circumferential direction about the longitudinal axis up to about 180 degrees.

72. An appliance for styling hair as claimed in claim 67, wherein the plurality of bristles is provided on the first hair treatment surface.

73. An appliance for styling hair as claimed in claim 67, wherein the plurality of ribs extends in the circumferential direction about the longitudinal axis up to about 180 degrees.

74. An appliance for styling hair as claimed in claim 67, wherein the hair treatment section further comprises a proximal end being proximate the handle section and a free end located in an outward direction along the longitudinal axis from the handle section, and wherein an outer edge of the rib member proximate the proximal end is further from the longitudinal axis than an outer edge of the rib member proximate the free end is from the longitudinal axis.

75. An appliance for styling hair as claimed in claim 74, wherein a height of the rib members tapers from the proximal end to the free end.

76. An appliance for styling hair as claimed in claim 67, wherein the plurality of bristles is provided on the first hair treatment surface and the plurality of rib members is provided on the second hair treatment surface and wherein the first hair treatment surface further comprises metal and the plurality of rib members further comprises plastics.

77. An appliance for styling hair as claimed in claim 67, wherein the first and second curvilinear surfaces are each formed from a generatrix of points generated by portions of a right circular cone intersected by a plane.

78. An appliance for styling hair as claimed in claim 77, wherein at least one of the first and second curvilinear surfaces is formed from a radius.

79. An appliance for styling hair as claimed in claim 67 wherein the bristles are disposed in offset relation to each other in the circumferential direction.

80. An appliance for styling hair as claimed in claim 67 wherein the bristles further comprise in the longitudinal direction at least one short bristle alternating with at least one long bristle.

81. An appliance for styling hair as claimed in claim 67 wherein the bristle mounting member comprises at least a first and a second shell, wherein the first shell further comprises at least partially the first hair treatment surface and the second shell further comprises at least partially the second hair treatment surface.

82. An appliance for styling hair as claimed in claim 81, wherein the shells are selected from a group of materials consisting of metal and plastics.

83. An appliance for styling hair as claimed in claim 67, wherein the first and second hair treatment surfaces further comprise material selected from a group of materials consisting of metal and plastics.

84. An appliance for styling hair of a user comprising a handle section, a heating element, and a heatable hair treatment section in operative engagement with the handle section and in heat transfer relationship to the heating element, the hair treatment section further comprising an elongated bristle mounting member having a longitudinal axis and comprising a first and a second hair treatment surface, and the hair treatment section further comprising a plurality of bristles carried by the bristle mounting member on one of said hair treatment surfaces and a plurality of rib members provided on the other of said hair treatment surfaces, said plurality of bristles extending in a circumferential direction about the longitudinal axis and being carried on said one hair treatment surface arranged in a plurality of generally longitudinally extending rows, the plurality of bristles forming a plurality of channels therebetween for engaging and directing the hair transversely about the longitudinal axis towards said one hair treatment surface and between said rows, wherein in cross section of the bristle mounting member transverse to the longitudinal axis, at at least one region on the first hair treatment surface a first point moving towards the longitudinal axis along the first hair treatment surface translates an incremental distance "y" as projected onto to a first vertical axis constructed normal to the longitudinal axis from a location on the first hair treatment surface furthest from the longitudinal axis while simultaneously translating an incremental distance "x" as projected onto a first horizontal axis constructed normal to each of the first vertical axis and the longitudinal axis, whereas a second point moving towards the longitudinal axis along the second hair treatment surface translates towards the longitudinal axis by an incremental distance less than "y" as projected onto a second vertical axis constructed normal to the longitudinal axis from a location on the second hair treatment surface furthest from the longitudinal axis when the second point translates the incremental distance "x" as projected onto a second horizontal axis constructed normal to each of the second vertical axis and the longitudinal axis, whereby either of the first or second hair treatment surfaces can style the hair of the user.

85. An appliance for styling hair as claimed in claim 84, wherein the plurality of bristles extends in the circumferential direction greater than 90 degrees about the longitudinal axis.

86. An appliance for styling hair as claimed in claim 85, wherein the plurality of bristles is provided on the first hair treatment surface.

87. An appliance for styling hair as claimed in claim 86, wherein the hair treatment section further comprises a proximal end being proximate the handle section and a free end located in an outward direction along the longitudinal axis from the handle section, and wherein an outer edge of the rib member proximate the proximal end are further from the longitudinal axis than an outer edge of the rib member proximate the free end is from the longitudinal axis.

88. An appliance for styling hair as claimed in claim 85, wherein the plurality of bristles extends in the circumferential direction about the longitudinal axis up to about 180 degrees.

89. An appliance for styling hair as claimed in claim 84, wherein the plurality of bristles is provided on the first hair treatment surface.

90. An appliance for styling hair as claimed in claim 84, wherein the plurality of ribs extends in the circumferential direction about the longitudinal axis up to about 180 degrees.

91. An appliance for styling hair as claimed in claim 84, wherein the hair treatment section further comprises a proximal end being proximate the handle section and a free end located in an outward direction along the longitudinal axis from the handle section, and wherein an outer edge of the rib member proximate the proximal end is further from the longitudinal axis than an outer edge of the rib member proximate the free end is from the longitudinal axis.

92. An appliance for styling hair as claimed in claim 91, wherein a height of the rib members tapers from the proximal end to the free end.

93. An appliance for styling hair as claimed in claim 84, wherein the plurality of bristles is provided on the first hair treatment surface and the plurality of rib members is provided on the second hair treatment surface and wherein the first hair treatment surface further comprises metal and the plurality of rib members further comprises plastics.

94. An appliance for styling hair as claimed in claim 84, wherein the first and second hair treatment surfaces are each formed from a generatrix of points generated by portions of a right circular cone intersected by a plane.

95. An appliance for styling hair as claimed in claim 94, wherein at least one of the first and second curvilinear surfaces is formed from a radius.

96. An appliance for styling hair as claimed in claim 84 wherein the bristles are disposed in offset relation to each other in the circumferential direction.

97. An appliance for styling hair as claimed in claim 84 wherein the bristles further comprise in the longitudinal direction at least one short bristle alternating with at least one long bristle.

98. An appliance for styling hair as claimed in claim 84 wherein the bristle mounting member comprises at least a first and a second shell, wherein the first shell further comprises at least partially the first hair treatment surface and the second shell further comprises at least partially the second hair treatment surface.

99. An appliance for styling hair as claimed in claim 98, wherein the shells are selected from a group of materials consisting of metal and plastics.

100. An appliance for styling hair as claimed in claim 84, wherein the first and second hair treatment surfaces further comprise material selected from a group of materials consisting of metal and plastics.

101. An appliance for styling hair of a user comprising a handle section, a heating element, and a heatable hair treatment section in operative engagement with the handle section and in heat transfer relationship to the heating element, the hair treatment section further comprising an elongated bristle mounting member having a longitudinal axis, the bristle mounting member further comprising first and second curvilinear hair treatment surfaces comprising respective first and second curvatures, the bristle mounting member having a generally rotational asymmetry about the longitudinal axis at at least portions of the first and second hair treatment surfaces, and the hair treatment section further comprising a plurality of bristles carried by the bristle mounting member on at least one of the hair treatment surfaces, said plurality of bristles extending in a circumferential direction about the longitudinal axis and being carried on said at least one hair treatment surface arranged in a plurality of generally longitudinally extending rows, the plurality of bristles forming a plurality of channels therebetween for engaging and directing the hair transversely about the longitudinal axis towards said at least one hair treatment surface and between said rows, wherein in cross section of the bristle mounting member transverse to the longitudinal axis the second curvature is shallower than the first curvature, whereby either of the first or second hair treatment surfaces can style the hair of the user.

102. An appliance for styling hair as claimed in claim 101, wherein the plurality of bristles extends in the circumferential direction greater than about 90 degrees about the longitudinal axis.

103. An appliance for styling hair as claimed in claim 102, wherein the plurality of bristles extends in the circumferential direction about the longitudinal axis up to about 180 degrees.

104. An appliance for styling hair as claimed in claim 102 wherein the bristles further comprise in the longitudinal direction at least one short bristle alternating with at least one long bristle.

105. An appliance for styling hair as claimed in claim 101, wherein the plurality of bristles is provided on the first hair treatment surface.

106. An appliance for styling hair as claimed in claim 101, wherein the bristle mounting member further comprises a plurality of rib members provided on the other of the first and second hair treatment surfaces, wherein the rib members extend in a circumferential direction transverse to the longitudinal axis.

107. An appliance for styling hair as claimed in claim 106, wherein the plurality of ribs extends in the circumferential direction about the longitudinal axis up to about 180 degrees.

108. An appliance for styling hair as claimed in claim 106, wherein the hair treatment section further comprises a proximal end being proximate the handle section and a free end located in an outward direction along the longitudinal axis from the handle section, and wherein an outer edge of the rib member proximate the proximal end are further from the longitudinal axis than an outer edge of the rib member proximate the free end is from the longitudinal axis.

109. An appliance for styling hair as claimed in claim 106, wherein the plurality of bristles is provided on the first hair treatment surface and the plurality of rib members is provided on the second hair treatment surface and wherein the first hair treatment surface further comprises metal and the plurality of rib members further comprises plastics.

110. An appliance for styling hair as claimed in claim 101, wherein the hair treatment section further comprises a proximal end being proximate the handle section and a free end located in an outward direction along the longitudinal axis from the handle section, and wherein an outer edge of the rib member proximate the proximal end is further from the longitudinal axis than an outer edge of the rib member proximate the free end is from the longitudinal axis.

111. An appliance for styling hair as claimed in claim 110, wherein a height of the rib members tapers from the proximal end to the free end.

112. An appliance for styling hair as claimed in claim 101, wherein the first and second curvilinear surfaces are each formed from a generatrix of points generated by portions of a right circular cone intersected by a plane.

113. An appliance for styling hair as claimed in claim 112, wherein at least one of the first and second curvilinear surfaces is formed from a radius.

114. An appliance for styling hair as claimed in claim 101 wherein the bristles are disposed in offset relation to each other in the circumferential direction.

115. A styling brush for styling hair of a user comprising a handle section, a heating element, and a heatable hair treatment section in operative engagement with the handle section and in heat transfer relationship to the heating element, the hair treatment section further comprising an elongated bristle mounting member having a longitudinal axis, the bristle mounting member further comprising a first heated hair treatment surface comprising a plurality of bristles disposed thereon in a circumferential direction about the longitudinal axis such that a first portion of the plurality of bristles is intersected by a line extending in a generally longitudinal direction and a second portion of the bristles is not intersected by the said line, the plurality of bristles forming a plurality of channels therebetween for engaging and directing the hair transversely about the longitudinal axis towards the first heated hair treatment surface and between said first and second portions of the bristles, and a second heated hair treatment surface comprising a plurality of rib members extending in a circumferential direction transverse to the longitudinal axis for separating strands of hair and supportedly guiding the hair strands towards the second heated hair treatment surface, whereby either of the first or second hair treatment surfaces can style the hair of the user.

116. A styling brush as claimed in claim 115, wherein the plurality of bristles is arranged in at least three generally longitudinally extending rows.

117. A styling brush as claimed in claim 115, wherein the bristles have proximal bristle bases and distal bristle ends, the proximal bristle bases being proximate the first hair treatment surface and the distal bristle ends located in an outward direction from the first hair treatment surface and the proximal bristle bases, wherein the ribs have proximal rib bases and distal rib ends, the proximal rib bases being proximate the second hair treatment surface and the distal rib ends located in an outward direction from the second hair treatment surface and the proximal rib bases, wherein the distal bristle ends define a first outer envelope surface and the distal rib ends define a second outer envelope surface, and wherein in cross section of the bristle mounting member transverse to the longitudinal axis an incremental arc of travel θ circumferentially along the first outer envelope surface defines two points on the first outer envelope surface spatially separated by a first circumferential distance whereas the incremental arc of travel θ circumferentially along the second outer envelope surface defines two points on the second outer envelope surface spatially separated by a second circumferential distance, the first circumferential distance being at least as great as the second circumferential distance.

118. A styling brush as claimed in 117, wherein the first circumferential distance is greater than the second circumferential distance.

119. A styling brush as claimed in claim 115, wherein the ribs have proximal rib bases and distal rib ends, the proximal rib bases being proximate the second hair treatment surface and the distal rib ends located in an outward direction from the second hair treatment surface and the proximal rib bases, wherein the distal rib ends define an outer rib envelope surface, and wherein in cross section of the bristle mounting member transverse to the longitudinal axis an incremental arc of travel θ circumferentially along the first hair treatment surface defines two points on the first hair treatment surface spatially separated by a first circumferential distance whereas the incremental arc of travel θ circumferentially along the outer rib envelope surface defines two points on the outer rib envelope surface spatially separated by a second circumferential distance, the second circumferential distance being at least as great as the first circumferential distance.

120. A styling brush as claimed in claim 119, wherein the second circumferential distance is greater than the first circumferential distance.

121. A styling brush as claimed in claim 115, wherein at least one of the first and second hair treatment surfaces comprises a curvilinear surface.

122. A styling brush as claimed in claim 121, wherein the first and second hair treatment surfaces comprise respective curvilinear surfaces formed from a generatrix of points generated by portions of a right circular cone intersected by a plane.

123. A styling brush as claimed in claim 122, wherein at least one of the first and second curvilinear surfaces is formed from a radius.

124. A styling brush as claimed in claim 121, wherein the first and second hair treatment surfaces comprise respective first and second curvatures, and wherein in cross section of the bristle mounting member transverse to the longitudinal axis the first curvature differs from the second curvature.

125. A styling brush as claimed in claim 124, wherein the second curvature is shallower than the first curvature.

126. A styling brush as claimed in claim 124, wherein an incremental arc of travel θ circumferentially along the first curvature defines two points on the first hair treatment surface separated by a first chordal distance whereas the incremental arc of travel θ circumferentially along the second curvature defines two points on the second hair treatment surface separated by a second chordal distance greater than the first chordal distance.

127. A styling brush as claimed in claim 115, wherein the plurality of bristles extends in the circumferential direction about the longitudinal axis up to about 180 degrees.

128. A styling brush as claimed in claim 115, wherein the plurality of ribs extends in the circumferential direction about the longitudinal axis up to about 180 degrees.

129. A styling brush as claimed in claim 115, wherein the hair treatment section further comprises a proximal end being proximate the handle section and a free end located in an outward direction along the longitudinal axis from the handle section, and wherein an outer edge of the rib member proximate the proximal end is further from the longitudinal axis than an outer edge of the rib member proximate the free end is from the longitudinal axis.

130. A styling brush as claimed in claim 115, wherein a height of the rib members tapers from the proximal end to the free end.

131. A styling brush as claimed in claim 115, wherein the first hair treatment surface further comprises metal and the plurality of rib members further comprises plastics.

132. A styling brush as claimed in claim 115 wherein the bristles are disposed in offset relation to each other in the circumferential direction.

133. A styling brush as claimed in claim 115 wherein the bristles further comprise in the longitudinal direction at least one short bristle alternating with at least one long bristle.

134. A styling brush as claimed in claim 115, wherein the plurality of bristles extends in the circumferential direction more than 90 degrees about the longitudinal axis.

135. A method of styling hair of a user, comprising the steps of:

providing, on a styling brush, a handle section, a heating element, and a heatable hair treatment section in operative engagement with the handle section and in heat transfer relationship to the heating element, the hair treatment section further comprising an elongated bristle mounting member having a longitudinal axis, the bristle mounting member further comprising a first hair treatment surface comprising a plurality of bristles disposed thereon in a longitudinal direction and in a circumferential direction about the longitudinal axis, wherein the plurality of bristles forms a plurality of channels extending generally transverse to the longitudinal axis, and a second hair treatment surface comprising a plurality of rib members extending in a circumferential direction transverse to the longitudinal axis, engaging a portion of the plurality of bristles with the hair, directing the engaged hair along the channels transversely about the longitudinal axis towards the first hair treatment surface, rotating the bristle mounting member about the longitudinal axis to form a first portion of a curl in the hair about the first hair treatment surface, contacting a portion of the rib members with a portion of the hair engaged about the first hair treatment surface, guiding strands of the portion of hair between the portion of the rib members towards the second hair treatment surface to form a second portion of the curl, transferring heat from the first and second hair treatment surfaces to the curl to set the curl, and releasing the portion of the plurality of bristles and rib members from the hair.

136. The method of styling hair according to claim 135, wherein the step of providing further comprises providing the plurality of bristle members in the circumferential direction about the longitudinal axis such that in cross section of the bristle mounting member transverse to the longitudinal axis, the bristles spaced circumferentially furthest apart from each other are bounded by an imaginary boundary having sides projecting in a direction towards the longitudinal axis that subtend an angle of at least about 45 degrees.

137. A method of styling short hair sections and long hair sections of hair of a user, comprising the steps of:

providing, on a styling brush, a handle section, a heating element, and a heatable hair treatment section in operative engagement with the handle section and in heat transfer relationship to the heating element, the hair treatment section further comprising an elongated bristle mounting member having a longitudinal axis, the bristle mounting member further comprising a first hair treatment surface comprising a plurality of bristles disposed thereon in a longitudinal direction and in a circumferential direction about the longitudinal axis, wherein the plurality of bristles forms a plurality of channels extending generally transverse to the longitudinal axis, and a second hair treatment surface comprising a plurality of rib members extending in a circumferential direction transverse to the longitudinal axis, engaging a portion of the plurality of bristles with hair of the short hair section, directing the engaged hair along the channels transversely about the longitudinal axis towards the first hair treatment surface, rotating the bristle mounting member about the longitudinal axis to form a curl in the hair about the first hair treatment surface, transferring heat from the first hair treatment surface to the curl to set the curl, releasing the portion of the plurality of bristles from the hair, rotating the bristle mounting member about the longitudinal axis to present a portion of the plurality of ribs to hair of the long hair section, inserting the portion of the rib members into the hair of the long hair section, guiding strands of the hair between the portion of the rib members towards the second hair treatment surface, rotating the bristle mounting member about the longitudinal axis to form a wave in the hair about the second hair treatment surface, transferring heat from the second hair treatment surface to the wave to set the wave, and releasing the portion of the plurality of ribs from the hair.

138. The method of styling hair according to claim 137, wherein the step of providing further comprises providing the plurality of bristle members in the circumferential direction about the longitudinal axis such that in cross section of the bristle mounting member transverse to the longitudinal axis, the bristles spaced circumferentially furthest apart from each other are bounded by an imaginary boundary having sides projecting in a direction towards the longitudinal axis that subtend an angle of at least about 45 degrees.

* * * * *